US005665113A

United States Patent [19]

Decker et al.

[11] Patent Number: 5,665,113

[45] Date of Patent: Sep. 9, 1997

[54] INFANT PACIFIER/PILLOW

[76] Inventors: Paulette S. Decker, 5508 9th St., Lubbock, Tex. 79416; Kelly R. Lynch; Chuck R. Lynch, both of 2508 S. Tyler, Amarillo, Tex. 79109; Doris D. Reeves, 4624 40th St., Lubbock, Tex. 79414; Evelyn L. Avent, 2108 67th St., Lubbock, Tex. 79412

[21] Appl. No.: 698,579

[22] Filed: Aug. 15, 1996

[51] Int. Cl.[6] ..... A61J 17/00

[52] U.S. Cl. ..... 606/234; 606/236; D24/194

[58] Field of Search ..... 606/234–236; 215/11.1–11.6; 5/436, 490, 497; D24/194

[56] References Cited

U.S. PATENT DOCUMENTS

| | | | |
|---|---|---|---|
| D. 337,385 | 7/1993 | Lussier . | |
| D. 358,653 | 5/1995 | Thomas . | |
| D. 360,693 | 7/1995 | Thomas . | |
| 546,033 | 9/1895 | Shepard . | |
| 651,647 | 5/1900 | Bird . | |
| 4,227,270 | 10/1980 | Rivera . | |
| 4,535,878 | 8/1985 | Grahl . | |
| 4,624,021 | 11/1986 | Hofstetter . | |
| 4,648,142 | 3/1987 | Bruning | 5/93 |
| 4,688,286 | 8/1987 | Miker, Jr. . | |
| 4,754,510 | 7/1988 | King . | |
| 5,236,975 | 8/1993 | LaRocca | 606/234 |
| 5,363,523 | 11/1994 | Blackburn . | |
| 5,522,849 | 6/1996 | Xiques et al. | 606/236 |
| 5,534,014 | 7/1996 | Demeritt et al. | 606/234 |

*Primary Examiner*—Michael Buiz
*Assistant Examiner*—Nancy Connolly
*Attorney, Agent, or Firm*—Palmatier, Sjoquist, Helget & Voigt, P.A

[57] ABSTRACT

The infant pacifier/pillow generally has an elongated circular shaped pillow having a central aperture and a side slot, a pacifier with an open center grasping handle and a removable pacifier holder. The pacifier open center grasping handle is slid into the pillows side slot. To hold the open center grasping handle in place, the pacifier holder which is essentially a rod with an end cap, is pushed down through the central aperture and through the handle's open center until the pacifier holder's end cap is substantially flush with the top of the pillow whereby the pacifier is held in place. The pacifier holder, sized approximately to the same diameter as the pillow's central aperture, is itself held in position and prevented from falling out of the pillow by the friction forces between the pillow material and the pacifier holder. However, the pacifier holder may easily be removed by an adult such that the pacifier may also be removed. With all components of the infant pacifier/pillow separated they can be easily washed and reassembled to provide the infant with a fresh device. The pillow may also be encased in a fabric sleeve that may also be washed.

14 Claims, 5 Drawing Sheets

INFANT PACIFIER/PILLOW

BACKGROUND

This invention relates to infant accessories and more particularly to an infant pacifier/pillow.

There are a number of devices available to help comfort infants. For instance, there are numerous types of baby blankets and stuffed animals or pillows which an infant can hold, snuggle against and cuddle with. Also available are pacifiers, a nipple-shaped device that infants can suck or bite upon to calm themselves. However, there are few devices available that combine the idea of a pacifier with a pillow.

U.S. Design Pat. No. 337,385 reveals a pacifier attached to a rectangular shaped block. However, the rectangular shape is unwieldy for an infant to grasp or wrap their arms around. Furthermore, the pacifier appears to be permanently attached to the rectangular block making cleaning and sterilizing of both the pacifier and block quite difficult.

For the foregoing reasons, there is a need for an infant pacifier/pillow wherein the pillow is of a shape easily grasped or held by infants and wherein the pacifier is removable from the pillow permitting independent and convenient cleaning of the pacifier and/or pillow.

SUMMARY

The infant pacifier/pillow generally comprises an elongated circular shaped pillow having a central aperture and a side slot, a pacifier with an open center grasping handle and a removable pacifier holder. The pacifier open center grasping handle is slid into the pillows side slot. To hold the open center grasping handle in place, the pacifier holder which is essentially a rod with an end cap, is pushed down through the central aperture and through the handle's open center until the pacifier holder's end cap is substantially flush with the top of the pillow whereby the pacifier is held in place. The pacifier holder, sized approximately to the same diameter as the pillow's central aperture, is itself held in position and prevented from falling out of the pillow by the friction forces between the pillow material and the pacifier holder. However, the pacifier holder may easily be removed by an adult such that the pacifier may also be removed. With all components of the infant pacifier/pillow separated they can be easily washed and reassembled to provide the infant with a fresh device. The pillow may also be encased in a fabric sleeve that may also be washed.

It is a principle object of the present invention to provide a new and improved combination infant pacifier/pillow of relative simple and inexpensive design, construction, and operation for use by an infant without fear of injury to the infant or damage to the device.

Another object and advantage of the present invention is that the infant pacifier/pillow incorporates both the comforting of a pillow and the comforting of a pacifier.

A further object and advantage of the present invention is that the infant pacifier/pillow is easily separable, by an adult, into its component parts whereby each of the component parts may be cleaned and reassembled to provide the infant with a fresh device.

A further object and advantage of the present invention is that the infant pacifier/pillow may be constructed to work with numerous types of existing, commercially available pacifiers.

A further object and advantage of the present invention is that the infant pacifier/pillow may be constructed of non-toxic hypoallergenic materials and is further constructed to ensure unrestricted breathing by the infant during use.

A further object and advantage of the present invention is that the infant pacifier/pillow is circular in shape making the pillow easy for an infant to grasp and/or wrap their arms around.

A feature of the present invention is an elongate shaped pillow having a central aperture and a side slot for releasable engagement of a pacifier having an open center grasping handle permitting separation of the pacifier from the pillow as desired by an individual.

Another feature of the present invention is a rod having an end cap which is adapted for penetrating engagement into the central aperture and through the opened center grasping handle for releasable engagement of the pacifier to the pillow.

Still another feature of the present invention is the substantially flush positioning of the end cap with the top of the pillow during engagement of the pacifier to the pillow.

Still another feature of the present invention is the diameter of the rod being substantially equal to the diameter of the center aperture where the rod is maintained within the central aperture by friction.

Still another feature of the present invention is a pillow formed of a closed cell foam material.

DRAWINGS

These and other features, aspects, and advantages of the present invention will become better understood with regard to the following description, appended claims and accompanying drawings where:

DETAILED DESCRIPTION

Figure 4:
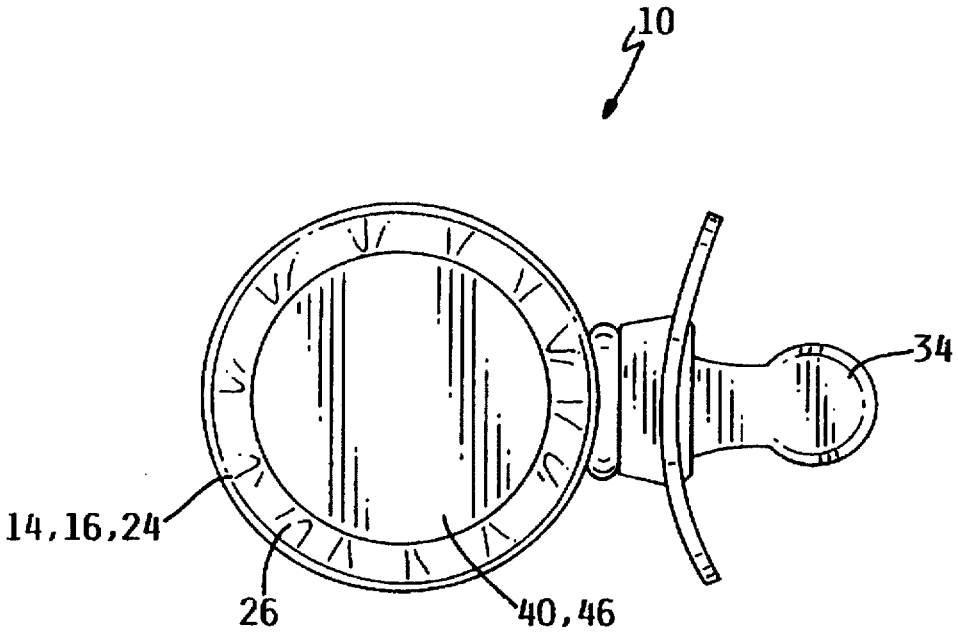
FIG. 4 is top plan view of the infant pacifier/pillow.
Figure 5:
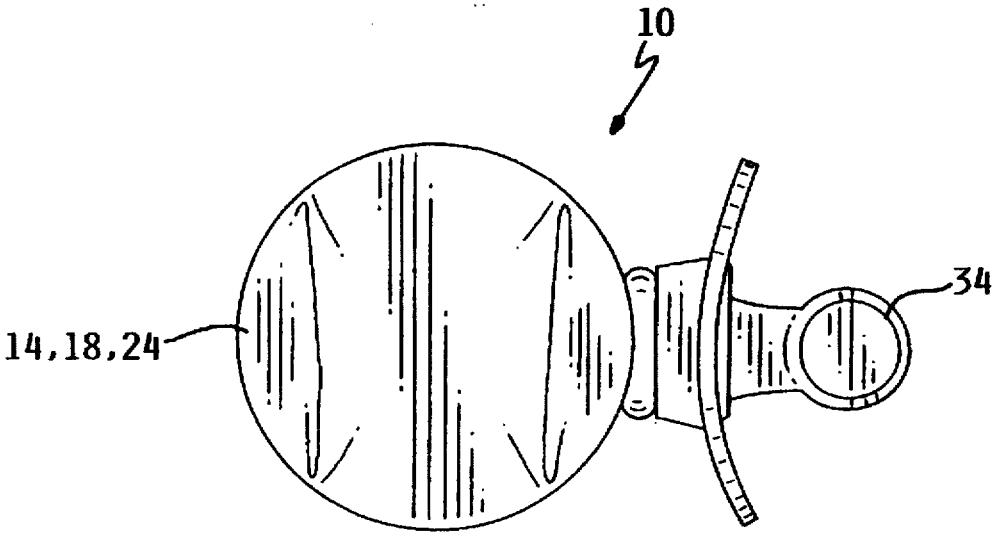
FIG. 5 is a bottom plan view of the infant pacifier/pillow.
Figure 6:
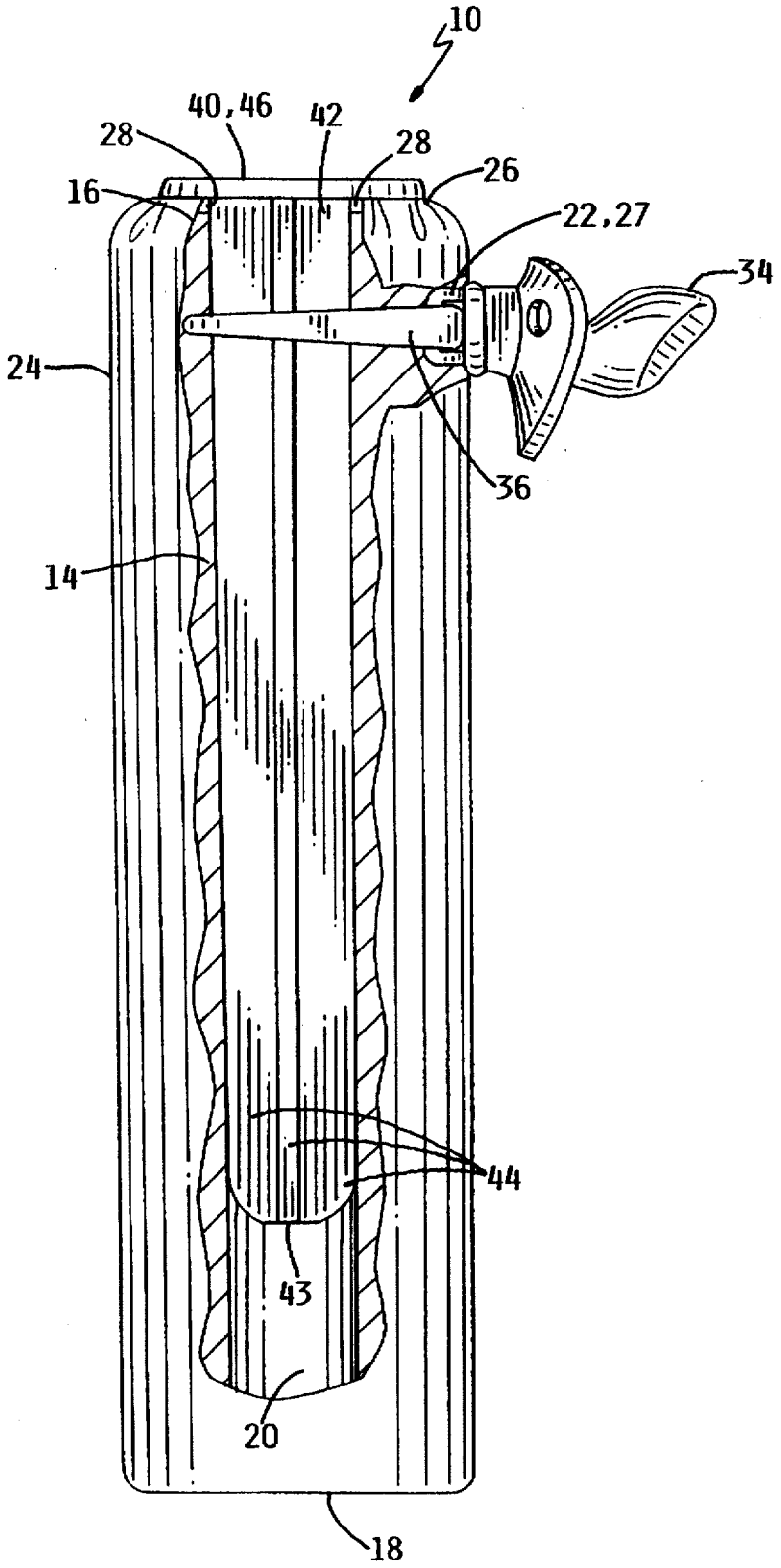
FIG. 6 is side cut-away view exposing the interior components of the infant pacifier/pillow.

The infant pacifier/pillow 10 generally comprises a pillow 14, a pacifier 34 and a pacifier holder 40, see FIGS. 4 and 6.

The pillow 14 may preferably be elongate and circular in shape as depicted in FIGS. 1–6. Alternatively, the pillow 14 may have any elongate shape as preferred by an infant including oval, square and/or rectangular. The pillow 14 should be of a length approximating the length of an infant's torso, generally 5–12 inches. While the width or diameter of the pillow 14 should approximate that which is graspable/huggable by an infant, generally 1–4 inches.

Figure 1:
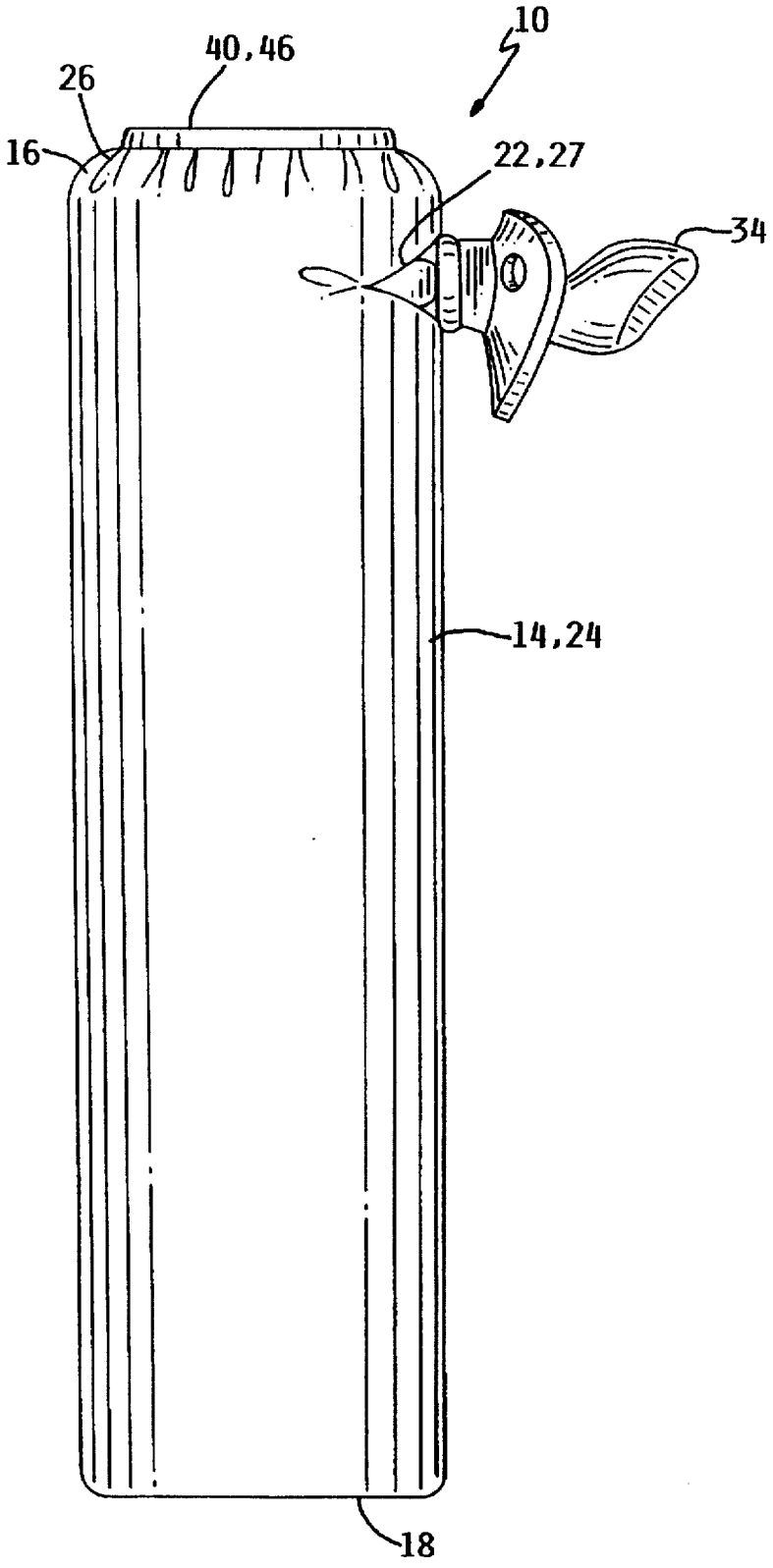
FIG. 1 is a side elevational view of the infant pacifier/pillow.
Figure 2:
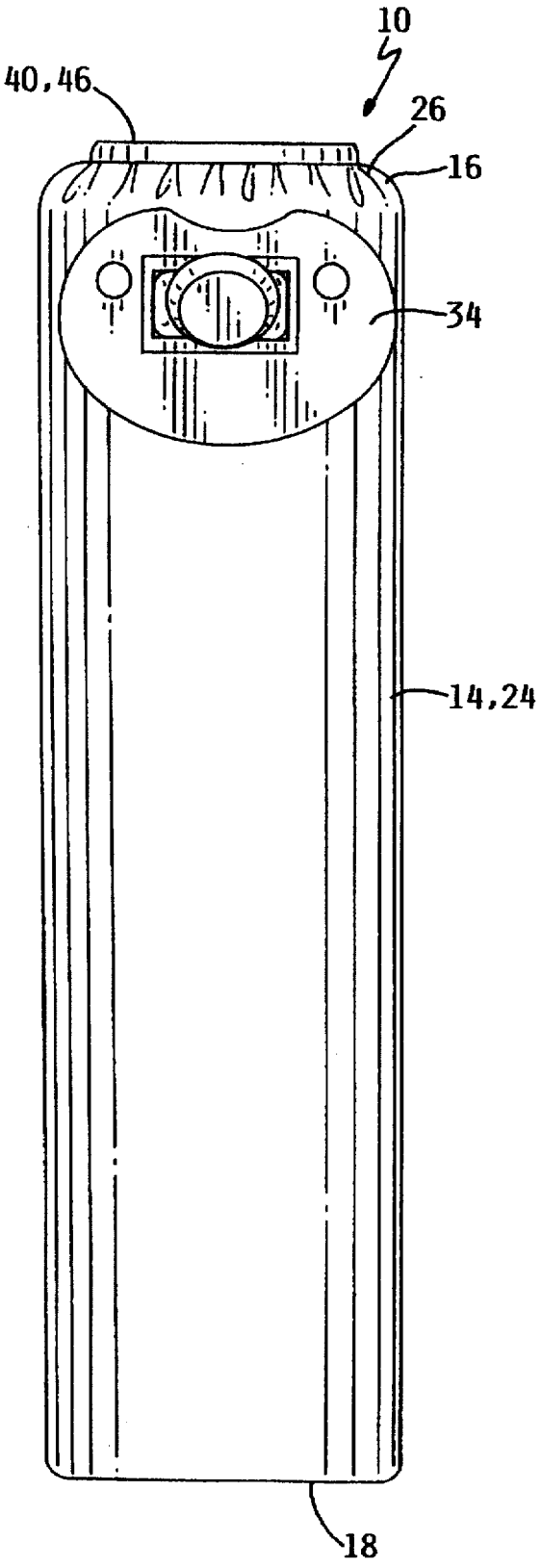
FIG. 2 is front elevational view of the infant pacifier/pillow.
Figure 3:
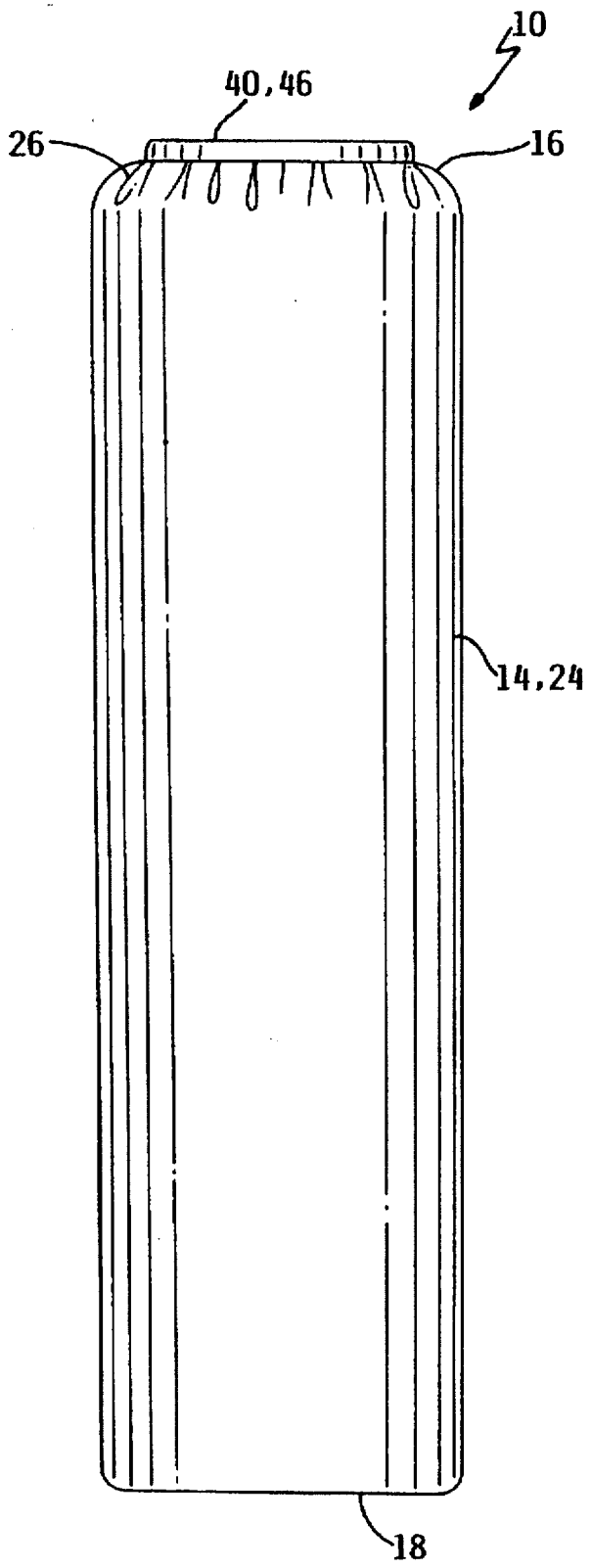
FIG. 3 is rear elevational view of the infant pacifier/pillow.

A central aperture 20 is preferably located within the pillow 14 where the central aperture 20 extends the full length of the pillow 14, top 16 to bottom 18, FIG. 6. A side slot 22 also traverses the pillow 14 and is located very near the top 16 as seen in FIG. 1 and 6. The pillow 14 is ideally formed of a closed cell high density foam that is hypoallergenic and washable in soap and water, however, other materials such as cotton and other various types of foam or foam rubber may be used. The pillow 14 may be encased in a removable fabric sleeve 24, see generally FIGS. 1–6, having an elasticized opening 26 and a side slot opening 27.

Any type, pattern, style, or texture of fabric may be used for the sleeve 24 at the preference of an individual. Additionally, a lightweight plastic disc 28 having approximately the same diameter as the pillow 14, as well as an identically sized central aperture, may be glued to the top 16 of the pillow 14 for added stability.

The pacifier 34 may be a standard commercially available pacifier incorporating an open center grasping handle 36, FIG. 6. The grasping handle 36 is inserted through the side slot opening 27 and into the pillow's side slot 22; the shape of the side slot 22 forcing the open center in the grasping handle 36 into alignment with the pillow's central aperture 20. It is important that the side slot 20 and thus, the pacifier 34 be located near the top 16 of the pillow 14, FIGS. 1, 2 and 6. This top 16 location ensures that the infant's breathing is unrestricted and that carbon dioxide and carbon monoxide does not build up around the infant's face. These problems are avoided because the infant's nose, when sucking on the pacifier 34, is above the pillow 14. Alternatively the pacifier 34, its grasping handle 36 and the side slot 22 may be engineered such that their operation together is unique prohibiting substitution with standard, commercially available pacifiers.

The pacifier holder 40 comprises a throat portion 42 and an end portion 46. The throat portion 42 is essentially a long rod comprised of four slats 44 equidistantly spaced, FIG. 6. The width across any two parallel slats 44 is approximately equivalent to the diameter of the pillow's central aperture 20. The end portion 46 may be formed of a thin disc having a diameter slightly smaller than the diameter of the pillow 14, the end portion 46 being attached to one end of the throat portion 42, FIGS. 4 and 6. To hold the pacifier 34 in position, the throat portion 42 is inserted through the top 16 of the pillow 14, into the central aperture 20 and through the open center of the pacifier grasping handle 36 until the end portion 46 is approximately flush with the pillow top 16 and is covering the fabric sleeve's elasticized opening 26, see FIG. 6.

The throat portion 42 may be of a length such that it can be inserted all the way through the central aperture 20, until the throat portion's bottom 43 is approximately flush with the pillow's bottom 18; a throat portion 42 of such length will add stability to the pillow 14. Alternatively, a shortened throat portion 42 may be used as long as the length is sufficient to extend through the pacifier grasping handle 36 and hold the pacifier 34 in engagement with the side slot 22 and the pillow 14.

Because the pacifier holder 40 is sized to approximately the same diameter as the pillow's central aperture 20, the pacifier holder 40 itself is held in position and prevented from falling out of the pillow 14 by the friction forces between the pillow 14 material and the pacifier holder 40. While a round central aperture 20, round end portion 46 and four slats 44 have been described, any shaped central aperture 20, end portion 46 and throat portion 42 will actually suffice as long as they complete the tasks of holding the pacifier 34 in releasable engagement to the pillow 14 and preventing the pacifier holder 40 from easily falling out of the pillow 14. The pacifier holder 40 may be made of any number of non-toxic materials such as injection molded plastic or wood.

The pacifier holder 40, usually held in a tight fit position within the pillow 14, may be removed by an adult thereby also allowing for the removal of the pacifier 34. With all parts of the infant pacifier/pillow 10 separated each component can be individually cleaned and then reassembled to provide the infant with a fresh device.

The pacifier holder 40 is the preferred attachment means however a number of other attachment means may be used. These attachment means may include VELCRO® strips to affix the pacifier grasping handle 36 to the pillow 14, elastic or fabric strips which may be looped through the pacifier grasping handle 36 and fastened by snaps or buttons to the pillow 14, and clamps located within the central aperture 20 which may be utilized to hold the pacifier grasping handle 36 in a desired position for engagement to the pillow 14.

In operation, the infant pacifier/pillow 10 allows an infant to grasp the pillow 14 to his or her chest while simultaneously sucking the pacifier 34 minimizing inadvertent loss of the pacifier 34 during use and providing the infant with cuddling comfort.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed:

1. A combination infant pacifier/pillow device comprising:

(a) an elongate pillow comprising a top, a central aperture, and a side slot;

(b) a pacifier comprising an open center grasping handle, the open center grasping handle inserted into the side slot; and (c) a removable pacifier holder comprising a throat portion, the throat portion inserted through the top and into the central aperture and through the open center grasping handle to releasably affix the pacifier to the pillow.

2. The combination infant pacifier/pillow device of claim 1, wherein the pillow is formed of a closed cell high density foam.

3. The combination infant pacifier/pillow device of claim 1, further comprising a fabric cover adapted to encase the pillow.

4. The combination infant pacifier/pillow device of claim 3, the fabric cover further comprising an elastic end.

5. The combination infant pacifier/pillow device of claim 1, the removable pacifier holder further comprising an end portion, the throat portion inserted through the top and into the central aperture and through the open center grasping handle for positioning of the end portion adjacent to the top whereby the pacifier is releasably affixed to the pillow.

6. The combination infant pacifier/pillow device of claim 1, further comprising a stabilizing disc attached to the top.

7. A combination infant pacifier/pillow device comprising:

(a) an elongate pillow comprising a top, a central aperture and a side slot located proximate to the top;

(b) a fabric cover, the fabric cover adapted to encase the pillow;

(c) a pacifier comprising an open center grasping handle, the open center grasping handle inserted into the side slot; and (d) a removable pacifier holder comprising a throat portion and an end portion, the throat portion inserted through the top and into the central aperture and through the open center grasping handle for positioning of the end portion proximate to the top whereby the pacifier is releasably affixed to the pillow.

8. The combination infant pacifier/pillow device of claim 7, wherein the pillow is formed of a closed cell high density foam.

9. The combination infant pacifier/pillow device of claim 7, the fabric cover further comprising an elastic end.

10. The combination infant pacifier/pillow device of claim 7, further comprising a stabilizing disc attached to the top.

11. A combination infant pacifier/pillow device using a pacifier comprising an open center grasping handle, the combination device comprising:

(a) an elongate pillow comprising a top, a central aperture and a side slot located proximate to the top, the open center grasping handle inserted into the side slot;

(b) a fabric cover, the fabric cover adapted to encase the pillow; and (c) a removable pacifier holder comprising a throat portion and an end portion, the throat portion inserted through the top and into the central aperture and through the open center grasping handle for positioning of the end portion proximate to the top whereby the pacifier is releasably affixed to the pillow.

12. The combination infant pacifier/pillow device of claim 11, wherein the pillow is formed of a closed cell high density foam.

13. The combination infant pacifier/pillow device of claim 11, the fabric cover further comprising an elastic end.

14. The combination infant pacifier/pillow device of claim 11, further comprising a stabilizing disc attached to the top.

* * * * *

UNITED STATES PATENT AND TRADEMARK OFFICE

CERTIFICATE OF CORRECTION

PATENT NO. : 5,665,113

DATED : September 9, 1997

INVENTOR(S) : Paulette S. Decker, Kelly R. Lynch, Chuck R. Lynch, Doris D. Reeves, & Evelyn L. Avent It is certified that error appears in the above-indentified patent and that said Letters Patent is hereby corrected as shown below:

On the title page, item [56]:

In the References Cited:

Fifth reference, delete "5/1900" and insert --6/1900--.

Twelfth reference, delete "5,236,975" and insert --5,263,975--.

Twelfth reference, delete "8/1993" and insert --11/1993--.

Signed and Sealed this

Second Day of December, 1997

Bruce Lehman

BRUCE LEHMAN

*Commissioner of Patents and Trademarks*

*Attest:*

*Attesting Officer*